US005106543A

United States Patent [19]

Dodds

[11] Patent Number: 5,106,543

[45] Date of Patent: Apr. 21, 1992

[54] APPARATUS AND METHOD FOR CONTROLLING THE DISCHARGE OR CONTINUOUS BLEED-OFF OF COOLING WATER AND EVAPORATIVE COOLERS

[76] Inventor: Diego E. F. Dodds, Guiraldes 687 (1641) Acassuso, Buenos Aires, Argentina

[21] Appl. No.: 683,641

[22] Filed: Apr. 11, 1991

Related U.S. Application Data

[63] Continuation-in-part of Ser. No. 569,134, Aug. 17, 1990.

[51] Int. Cl.[5] ..... B01F 3/04

[52] U.S. Cl. ..... 261/36.1; 137/244; 137/434; 222/149; 261/97; 261/DIG. 11; 261/DIG. 46; 261/70

[58] Field of Search ..... 137/244, 242, 434; 222/149, 151; 239/116, 102.1; 261/DIG. 46, 36.1, 97, DIG. 11, 70

[56] References Cited

U.S. PATENT DOCUMENTS

| | | | |
|---|---|---|---|
| 67,866 | 8/1867 | French | 137/244 |
| 726,395 | 4/1903 | Bedworth | 137/244 |
| 1,952,765 | 3/1934 | Maurer | 239/116 |
| 2,181,956 | 12/1939 | Woolley | 137/244 |
| 2,656,076 | 10/1953 | Von Essen | 222/149 |
| 2,804,338 | 8/1957 | Johnston | 239/116 |
| 2,859,766 | 11/1958 | Shuldener | 261/DIG. 46 |
| 3,142,310 | 2/1964 | Feldermann | 137/434 |
| 3,687,369 | 8/1972 | Johnstone | 239/102.1 |
| 4,006,843 | 2/1977 | Martinez | 137/244 |

*Primary Examiner*—Tim Miles
*Attorney, Agent, or Firm*—Jim Zegeer

[57] ABSTRACT

Method and apparatus for controlling the discharge or continuous bleed-off of cooling water of evaporative coolers and cooling towers includes a container for receiving water from the cooling water system via an adjustable float valve. An orifice at the bottom of the container, which may be adjustable in height, allows water to flow to a device for eliminating suction effects or depression caused by the hydrostatic head of water below the container and a cleaning device, which may oscilate, operated by movement of the float valve keeps the orifice clean.

11 Claims, 5 Drawing Sheets

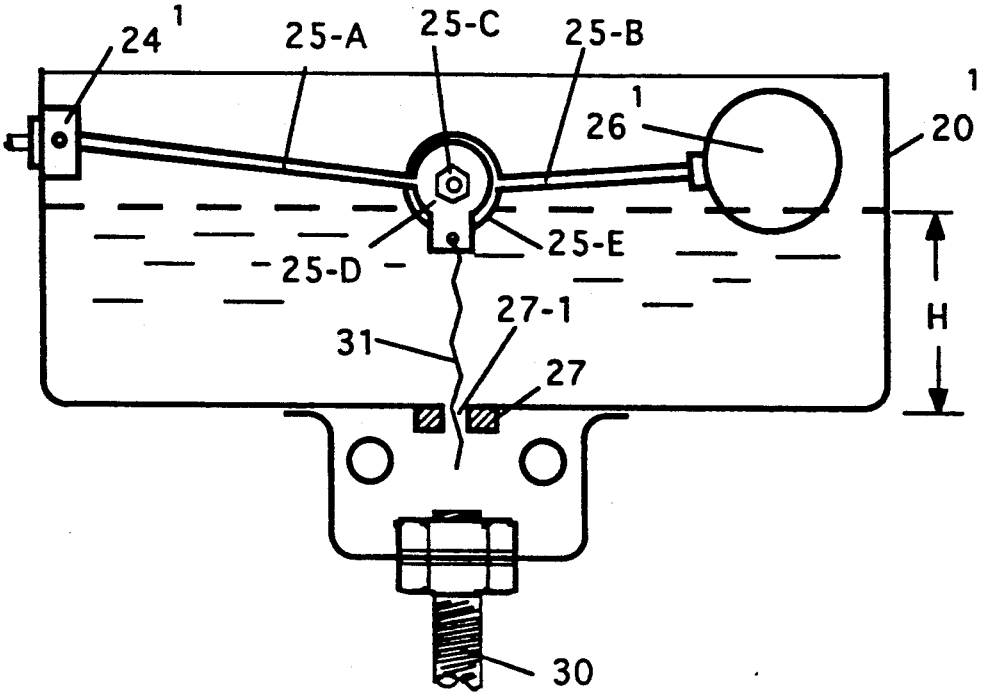
FIG. 6-A
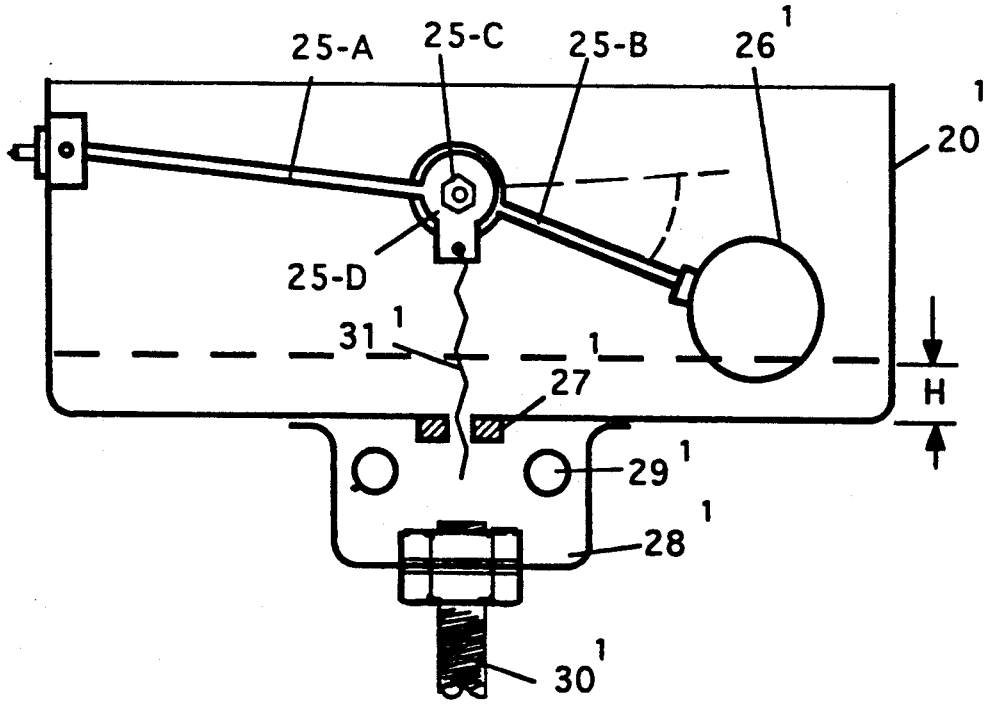
FIG. 6-B

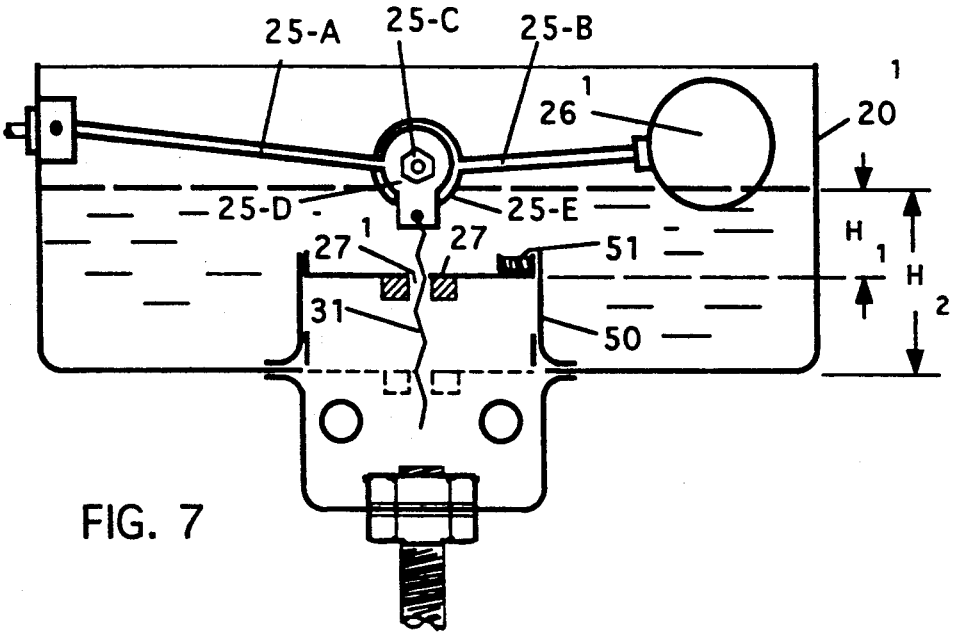
FIG. 7
NOTE: ARM 25 CAN BE EITHER FIXED (AS IN FIG. 1D) OR ADJUSTABLE (AS SHOWN IN FIG. 7).
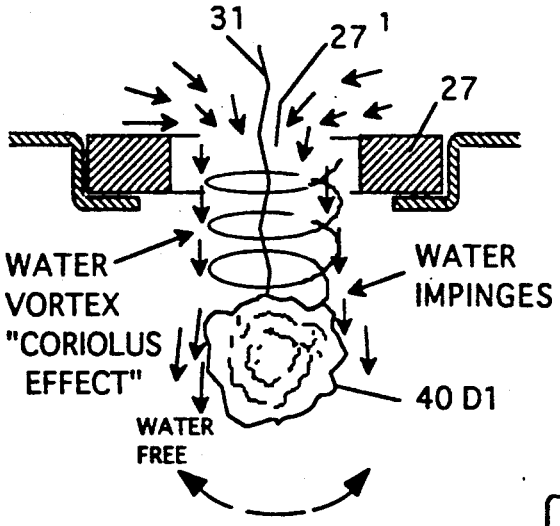
FIG. 8-A
KNOT OR BALL AT END OF TWINE
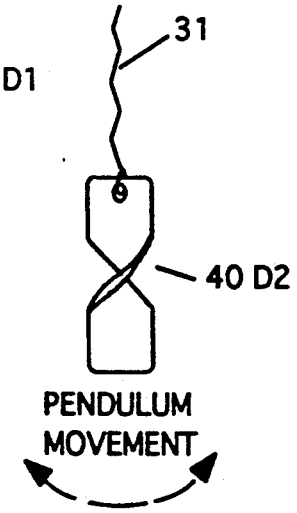
PENDULUM MOVEMENT
FIG. 8-B
TWISTER OR HELIX
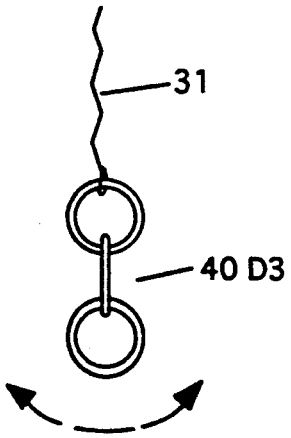
FIG. 8-C
CHAIN-RINGS
MATERIALS:
PLASTIC OR METAL

APPARATUS AND METHOD FOR CONTROLLING THE DISCHARGE OR CONTINUOUS BLEED-OFF OF COOLING WATER AND EVAPORATIVE COOLERS

REFERENCE TO RELATED APPLICATION

This application is a continuation-in-part of my application Ser. No. 07/569,134 filed Aug. 17, 1990 for "APPARATUS AND METHOD FOR CONTROLLING THE DISCHARGE OR CONTINUOUS BLEED-OFF OF THE COOLING WATER OF EVAPORATIVE COOLERS".

BACKGROUND AND BRIEF DESCRIPTION OF THE DRAWINGS

The present invention relates to an improvement for controlling the discharge or continuous bleed-off of water in recirculated systems or circuits, comprised in cooling towers and evaporative coolers used for mechanical refrigeration as disclosed in my above-identified application.

In my above-identified application I disclose a method and apparatus for obtaining a more accurate and reliable control of the discharge or bleed-off of the cooling water than those obtained by means for conventional bleeding. By this new way of control there is no need of permanent personal attendance and at the same time, it avoids waste or pilferage of water consumption.

It is well known that in all evaporative cooling processes, such as in a water cooling tower and in evaporative condensers, used for mechanical refrigeration, it is unavoidable to provoke the concentration of the solids contained in the recirculated water of the cooling circuit, which, in general, comprise of a plurality of water spray nozzles supplied by the water piped from the discharge of a water recirculating pump, which is collected in a water basin, which has means to replenish water via a valve and has a drain out pipe.

The concentration of solids in the water occurs, except in rare exemptions, because the waters of the public grid of those coming from wells, contain minerals in the form of carbonates, sulfates, etc., and as in the evaporative cooling process a part of the mass of water to be cooled is lost, by evaporation, those minerals contained in the evaporated fraction shall be retained in the rest of the mass of water increasing permanently the concentration of the solids.

This implies that to hold the system on a steady rate it shall be necessary to make-up or replenish the water lost by evaporation, incorporating a new quantity of water which brings its own content of minerals.

In view of this, it is easy to understand that after a certain time in operation, the concentration of solid minerals in the recirculating mass of water will reach extremely high values which shall force termination of operation of the equipment supposed to be cooled.

Some of the inconveniences derived from the excessive concentration of calcium carbonates and other chemical compounds (also known as "hardness"), as as follows:

a) scale build-up on the heat transfer surfaces,
b) greater abrasion and ware out of the seals, packings and rotors of the recirculating pumps,
c) stoppage or block-up of tubing and piping, of filters, and equipment being served, with danger of stopping all water circulation.

In relation to the calcium carbonate scales mentioned in (a), it is common knowledge of their effect as thermal insulators; thus diminishing the heat transmission and the overall thermal efficiency of the equipment.

In the United States it is common practice not to allow the recirculating water to concentrate any higher than 170 ppm, following the recommendations by ASHRAE (American Soc. Heating Refrig. and Air Conditioning Eng.) for water used in cooling towers and evaporative condensers.

The time it will take to reach these concentrations will depend entirely on the initial hardness of the make-up of the water.

To hold the concentration within the established limits, it shall be necessary to obtain a continuous dilution of the recirculated water. For a better understanding of the mechanics of the dilution, the following example should be of help:

The make-up for a cooling tower contains 100 ppm of $Ca\ CO_3$; the recirculated water should not contain any higher than 180 ppm; which is the quantity of water make-up required for each lb. of water lost by evaporation:

where,

P1 = water lost by evaporation (lbs.)
P2 = excess water required to control concentration (lbs.)
P3 = total make-up water (lbs.)

where,

P1 = 1 lb., then, P3 = P1 + P2 therefore, $P3 \times 100\ ppm = (P1 \times 0\ ppm) + (P2 \times 180\ ppm)$
$P2 = 100/180 - 100 = 1.25$ lb.
$P3 = 1 + 1.25 = 2.25$ lbs.

Therefore, if of the 2.25 lbs. make-up which enter the recirculating circuit, 1 (one) lb. is lost by evaporation, the excess of 1.25 lb. must be eliminated by some other means, in a continuous manner, to hold the process in a steady state.

In practice, when the hardness of the make-up water is close or higher that the established limit of concentration, the problem is solved via external chemical treatment or water softening or via internal treatment with additives fed into the recirculating waters.

Therefore, excepting the case when soft water, with zero hardness is used for make-up, there is always a need to provoke the discharge of a fraction of the recirculated water to hold the dilution under control and/or for eliminating the solid matters and residual muds from the chemical treatments and dust precipitated from the air going through the tower.

There are normally two ways to attain the continuous discharge or bleed-off in cooling towers and evaporative condensers:

a) by overflow of the water basin level,
b) by diverting to the drain part of the water flowing through the recirculation piping.

The first of the methods mentioned above has been depicted in FIG. 3, shown on a cooling tower, which normally comprises a tube (1) which receives the incoming hot water, with a series of nozzles (2) for spraying water over a heat exchanging surface (3) to attain a heat transfer of heat from the water to a mass of air induced by a fan (4).

The water is collected in a basin (5), which has a pipe (6) for make-up water through a valve 7, controlled by float 8, and a conduit 9 for removing the cooled water by means of pump 10 which delivers to pipe 11 to the recirculating circuit where the cycle is completed returning the heated water back to the nozzles 2. The basin 5 also has a drain pipe 12 into which the overflow pipe 13 is connected to cause the continuous bleed-off of the circuit.

The method just described, for continuous bleed-off, is not advisable because of several reasons, the main one because the water shall continue flowing out of the basin through 13 even after the pump has been stopped, which means a waste of water; another reason is the lack of a precise control of the amount drained on account of the oscillations on the surface of the water in the basin, since as the velocity of discharge is a function of $\sqrt{2gh}$, these fractional differences of level can represent large fluctuations of water drained out unnecessarily.

The second method mentioned above, that is, extracting water from the recirculating piping, has been represented in FIG. 4 for a cooling tower similar to the one shown in FIG. 3, and in FIG. 5 for an evaporative condenser.

In the case of FIG. 4, the pipe (1), hot water inlet, is linked with drain 12, via a valve 15 through pipe 14; valve 15 controls the rate of bleed-off of the recirculated system and it is held at an almost constant pressure. In this example, pump 10 delivers through outlet 11 the cold water from the basin 5, when the pump is stopped so shall the bleed-off.

In the case of FIG. 5, which represents an evaporative condenser, the discharge or bleed-off is also controlled by valve 15', installed on pipe 14,, which connects pipe 11' coming from pump 10 with the drain pipe 12; here again the valve 15' operates under the hydrostatic pressure as in FIG. 2.

The arrangement described as the second method is perfectly acceptable in practice, as long as the amount of bleed-off is of great magnitude (gpm), otherwise the opening of the valve will be so small that any minor particle or dirt or debris circulating with the water can plug up the flow.

It should be mentioned that in most large installations there is trained personnel, and sometimes laboratories, in charge of controlling the quality of the make-up water as well as controlling the amount of bleed off. This means that where real help is needed is in small and medium size installations and particularly if the control of the water hardness can be done with a minimum of personal attendance.

The category of small and medium size installation of cooling towers and evaporative conndensers falls between the ranges of 100,000 up to 4 million BTU per hour.

In these types of thermal equipment, the heat exchanging takes place with saturated air at about 95 degrees Fahrenheit, at this temperature the latent heat of vaporization is 1039 BTU per lb.

Table 1 shows the quantity of water lost by evaporation for several heat loads and the five columns on the right the corresponding bleed-offs, in GPH (gal. per hour) required to hold a steady concentration of 180 ppm, without the addition of chemicals, using different concentrations of ppm in the make-up water.

TABLE 1

| Thermal Load BTUH | NET EVAPORATION Loss Gal/Hour | Rate of Bleed-off required - Gal/Hour | | | | |
|---|---|---|---|---|---|---|
| | | Hardness 50 ppm | Hardness 75 ppm | Hardness 100 ppm | Hardness 125 ppm | Hardness 150 ppm |
| 100,000 | 11.5 | 4.4 | 8.2 | 14.4 | 26.1 | 57.5 |
| 250,000 | 28.7 | 11.0 | 20.5 | 35.9 | 65.2 | 143.5 |
| 500,000 | 57.5 | 22.1 | 41.1 | 71.9 | 130.7 | 287.5 |
| 1,000,000 | 115.0 | 44.3 | 82.2 | 143.8 | 261.4 | 575.0 |
| 2,000,000 | 230.0 | 88.5 | 164.3 | 287.5 | 522.7 | 1150.0 |
| 4,000,000 | 460.0 | 177.0 | 328.7 | 575.0 | 1045.4 | 2300.0 |

In cooling towers and condensers as those illustrated in FIG. 3 through 5, the average head in the recirculated circuit is 500 meters water column. The velocity of discharge through an orifice is $=c\sqrt{2gh}$, and the size of the orifice shall be a function of the flow in cubic meters per second to be bleed-off.

For reasons to be explained further on, the Table 2 has been prepared with the orifice sizes required for the continuous bleed-off for the GPH indicated in Table 1. A value of $c=0.7$ has been assumed to calculate all the orifices.

TABLE 2

| THERMAL Load BTUH | Diameter of the orifices for Bleed-off (inches) | | | | |
|---|---|---|---|---|---|
| | Hardness 50 ppm | Hardness 75 ppm | Hardness 100 ppm | Hardness 125 ppm | Hardness 150 ppm |
| 100,000 | 0.0364 | 0.0496 | 0.0658 | 0.0886 | 0.1314 |
| 250,000 | 0.0575 | 0.0784 | 0.1039 | 0.1400 | 0.2076 |
| 500,000 | 0.0815 | 0.1111 | 0.1473 | 0.1984 | 0.2942 |
| 1,000,000 | 0.1154 | 0.1572 | 0.2086 | 0.2809 | 0.4166 |
| 2,000,000 | 0.1631 | 0.2222 | 0.2948 | 0.3970 | 0.5888 |
| 4,000,000 | 0.2306 | 0.3142 | 0.4169 | 0.5613 | 0.8324 |

As mentioned earlier, the flow, for the bleed off, is controlled by means of a valve. It's customary to use globe or needle valves for this purpose, therefore the amount of water flow will be defined by the annular opening formed between the valve seat and the conical plunger.

Assuming a cooling tower were using a ½" globe valve and it were necessary to adjust the bleed-off to drain 143.8 GpH (see Table 1 for 1 MM BTUH) with make-up water with 100 ppm), then the free area of the annular section must be equivalent to the cross-section of an orifice of 0.2086" diameter; assuming the diameter of the valve seat were 0.5000", then the conical plunger would have to be introduced until the clearance was 0.0228". It's obvious that even minute particles of dirt will be sufficient to obstruct the pass of the water and consequently provoke an alteration of the GpH blowdown original planned.

In instances when there is a shortage of make-up water or when the hardness is higher than 125 or 150 ppm, it shall be necessary to use chemical products that will modify (increase) the solubility of calcium carbonates in the water; this way will lessen the scaling formations on the heat transfer surfaces. For example, holding a concentration of 2.5 ppm of polyphosfate in the recirculating water, for the same load of the above example (1 MM BTUH), with make-up water with 100 ppm, the continuous blow down shall be 64 GPH instead of the 143.8 GPH required with no chemical treatment.

It is frequent to find water which contains 300 ppm and even 600 ppm of hardness; assuming the same load of 1 MM BTUH, with make-up water with 300 ppm, holding the concentration of polyphosfate in 4.5 ppm, the blow down shall be 181 GPH.

The examples mentioned above are proof of how difficult it is to control properly the continuous blow down in a recirculating circuit serving a small or medium size installation, such as cooling towers and evaporative condensers.

The improvements attained with my above-identified invention will allow a more accurate and reliable way of controlling the continuous blow down or bleed-off than the methods in current use, particularly for minimum flows of water. Those improvements warrant an almost non-clogging condition, a very accurate flow control, and with virtually no attendance required; the cost of the apparatus is very low and it is adaptable to all types of cooling tower and evaporative condensers.

THE PRESENT INVENTION

As explained above, and in my above-identified application Ser. No. 07/569,134, the mass flow of water through the orifice was controlled by the height of the water level "H" in a control container, the basic equation being $V = A \times C \times 26 \times H$ where:

V = mass flow
A = area of the orifice
C = coefficient for orifice shape
G = acceleration of gravity
H = height of the water in the control container The rate of continuous blow down (CBD) required for any installation is calculated as a function of the heat load and the quality or hardness desired or allowable in the recirculated water circuits.

In many instances an installation is started and held for a prolonged period when it is only working 50% or less of the design load and eventually the load may reach 100% design condition. The CBD unit for such a case should be selected for full load condition with an orifice size corresponding to 100% load. However, in such case during the initial stages (50% or less of a design heat load) there will be a large waste of water (up to 100%) which will stop when at a later date the CBD system is working at full load.

There are two (2) ways to eliminate this waste: (1) reduce the size of the orifice in the control container, or (2) reduce the water level "H". In my above-identified application the size of the orifice could be adjusted. However, if the orifice gets very small there will be risk of debris interrupting full flow, thus losing control of the bleed-off. According to the present invention, the size of the orifice is fixed (particularly in smaller installations) and the height of the water "H" is the preferred method when dealing with relatively low flows of water. This is done by adjusting the arm of the float valve or by adjusting the level of the orifice, thus reducing the distance between the orifice and the constant water level.

In my above-identified application the orifice cleaner filament was mounted from the float arm and passed through the orifice to continuously clean same. Practice has taught that depending on the velocity of water through the orifice, and the actual diameter thereof, the vortex or corioles acceleration forms a circular ring of water with a hollow core the cleaner tends to stay in the hollow core. (The Corioles phenomena is noticeable when draining a bath tube or kitchen sink.) A further feature of the present invention is the provision of a water flow activated cleaner agitator.

DESCRIPTION OF THE DRAWINGS

The above and other objects, advantages and features of the invention become more apparent when considered with the following specification and accompanying drawings wherein:

FIG. 6*a* illustrates one embodiment of a float device for adjusting the height "H" of water in the control container or vessel, and FIG. 6*b* shows the effect of adjusting the float device, FIG. 7 illustrates a further embodiment of the height "H" adjustment feature of the invention, and FIGS. 8*a*, 8*b* and 8*c* are exemplary embodiments of water flow activated orifice cleaner agitator.

DETAILED DESCRIPTION OF THE INVENTION

Figure 1A:
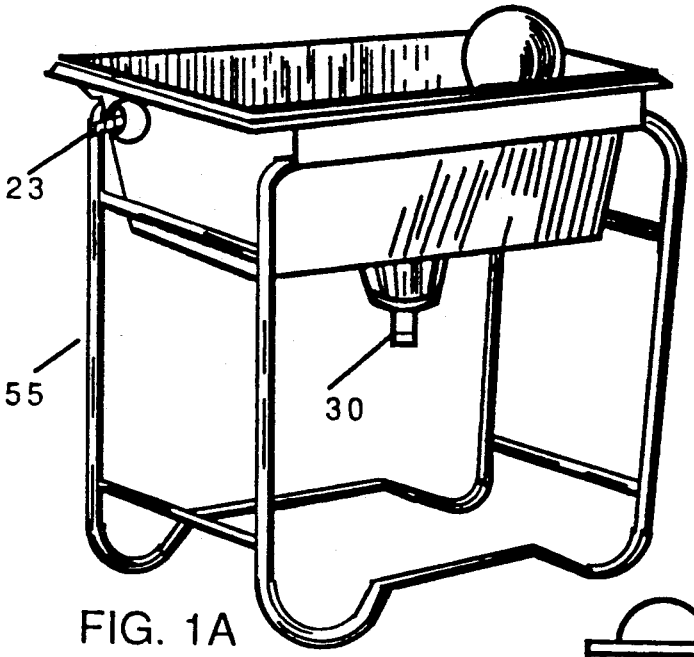
FIG. 1*a* is an isometric perspective view of an apparatus for controlling the continuous bleed-off of cooling water of an evaporative cooler incorporating the invention.

The invention comprises a container 20 which receives water from the recirculating circuit via a pipe 22 and a float valve 24 connected to float 26 by arm 25 to control the level in the container or tank in compensation of the water which continuously drains out of the tank through an orifice 27 placed on the bottom of said tank.

Figure 2:
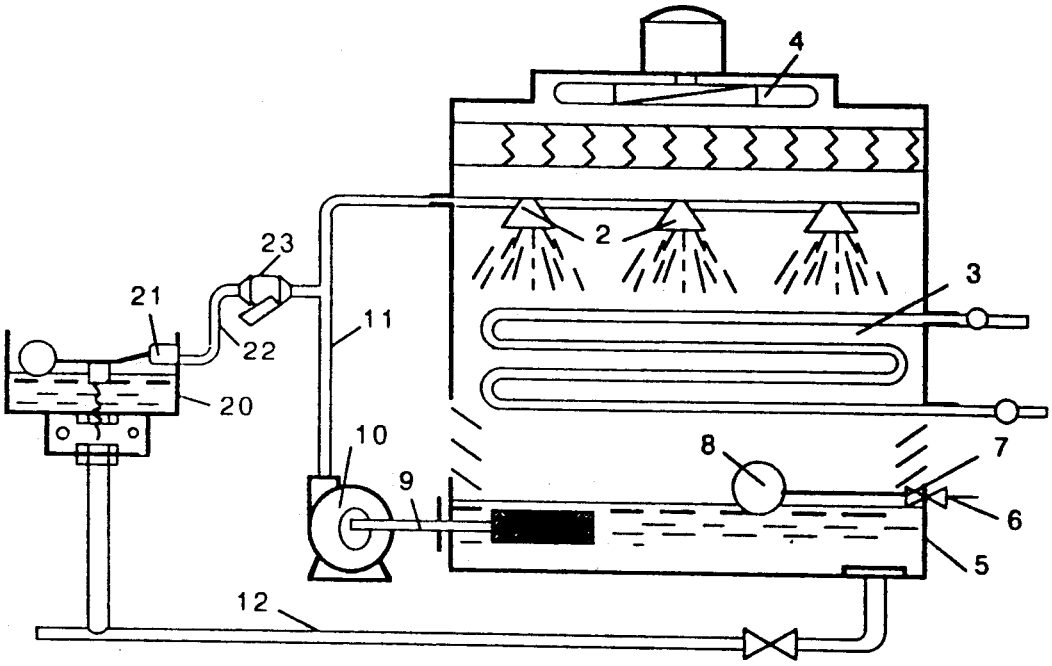
FIG. 2 is a schematic view of the cooling fluid circuit of an evaporative condenser incorporating the invention.
Figure 3:
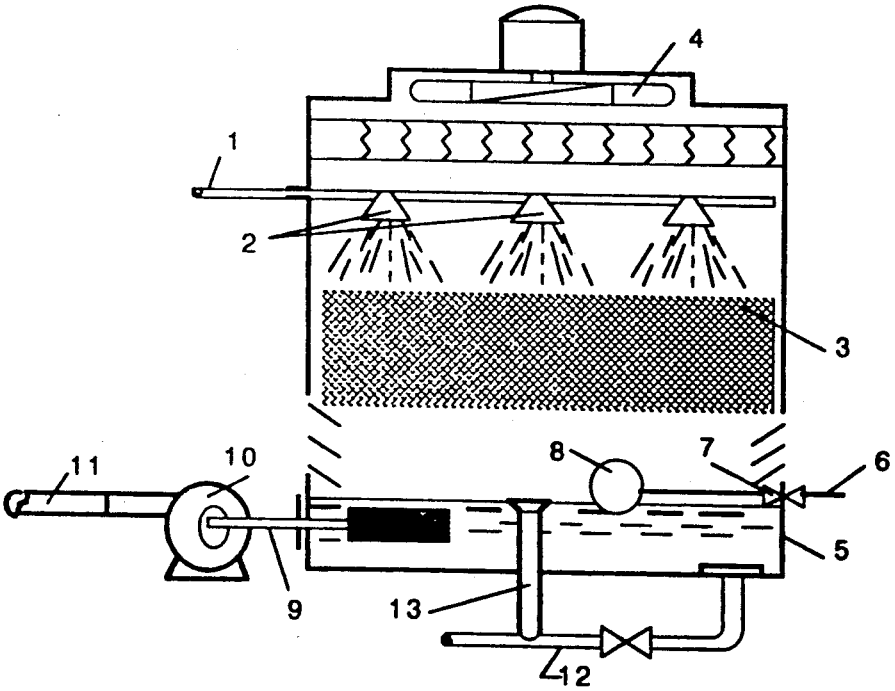
FIG. 3 is a schematic illustration of known cooling circuit of a cooling tower.
Figure 4:
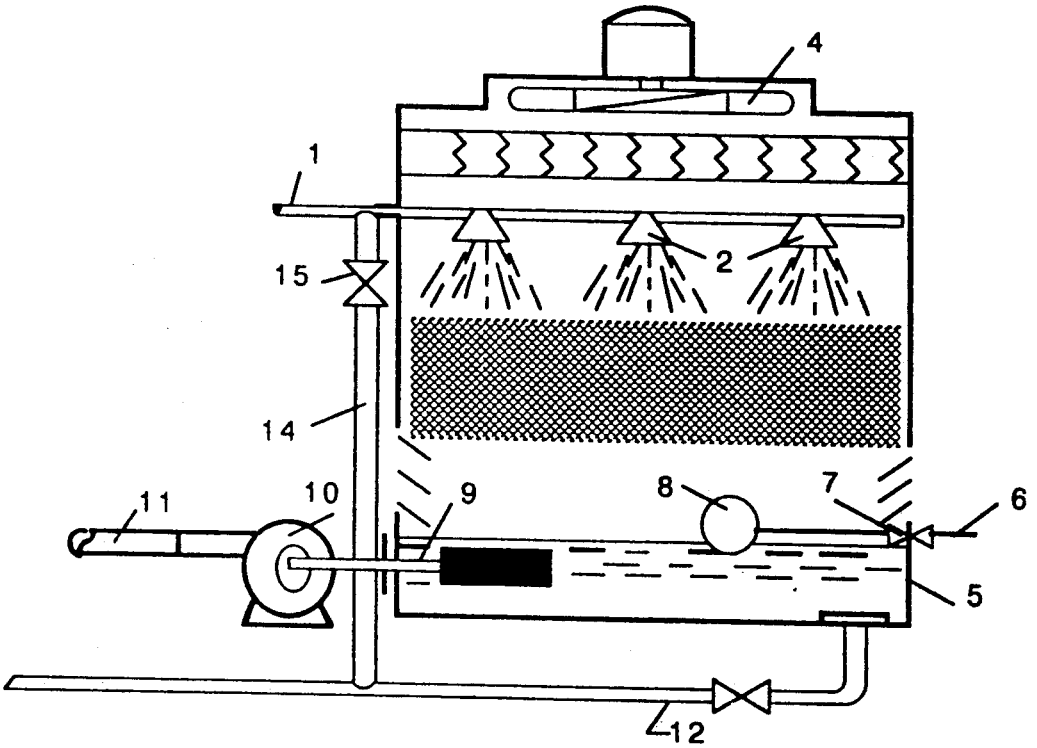
FIG. 4 is a further schematic illustration of a known cooling circuit of a cooling tower.
Figure 5:
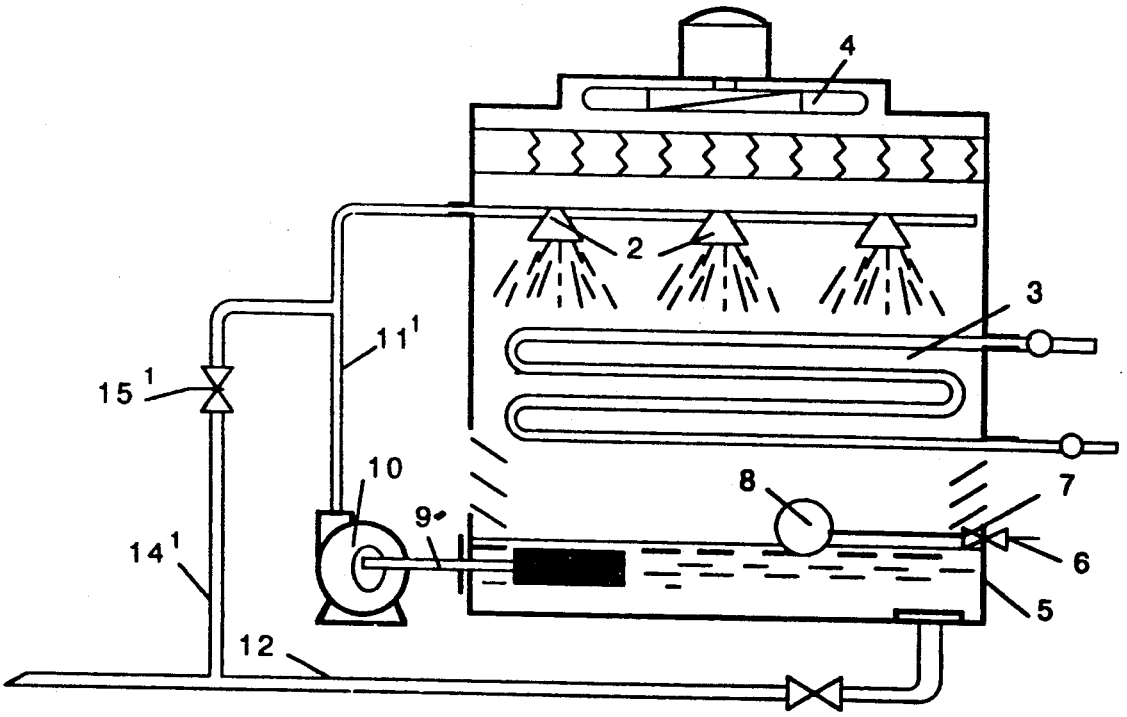
FIG. 5 is a schematic illustration of a known cooling water circuit for an evaporative condenser.

The water which passes through the orifice 27 is received by a receptacle 28, fixed to the bottom of container or tank 20. The water then is conveyed from receptacle 28 by a vertical tube 30 to the drain pipe 12 of the basin 5 (FIG. 2).

Figure 1C:
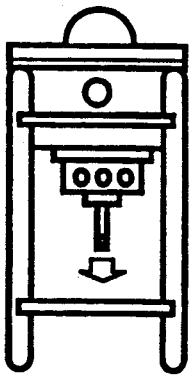
FIG. 1*c* is an end view thereof.
Figure 1B:
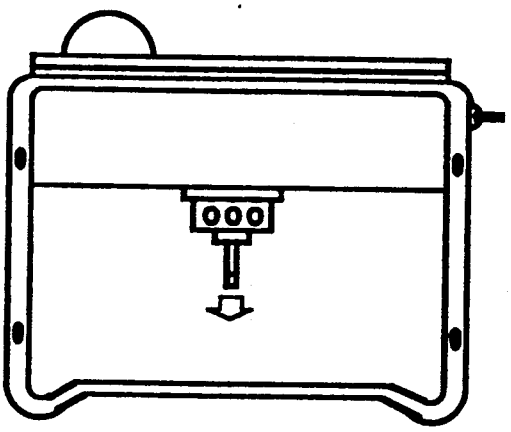
FIG. 1*b* is an side elevations view thereof.

The receptacle has openings 29 on its sidewalls with the purpose of eliminating any suction effects or depression which could be created by the hydrostatic head of the water flowing down the vertical tube on their way to the drain. This arrangement assures that the water inside the tank is unaffected by external forces or pressures by the incoming or outgoing waters. As shown in FIGS. 1*a*, 1*b*, and 1*c*, container 20 and receptacle 28 are supported at a predetermined level by support stand SS. Cover CC may have a bubous cavity BC formed therein to accommodate the ball float 26.

Finally, the apparatus has cleaner means for removing dirt particles and scale films which could otherwise obstruct or plug the orifice 27, on the bottom of the tank. The cleaner comprises a filament element 31 such as a thread, wire or fine rod, whose top or upper end is connected to the arm 25 of the float valve, and the lower length is introduced into the orifice on the bottom of the tank.

As the continuous blow down shall stop every time the recirculating pump stops, the tank will dry out and it is therefore very probable that when the residual humidity, inside the orifice, drys out, the solids this humidity contained shall leave a fine residual film.

The filament element 31 described above, when the pump is once again started, by virtue of the minute vibrations of the float arm in addition to the oscillations of the water level in the tank shall sense these movements and in turn the filament shall make multiple displacements inside the orifice touching the scraping the contour, thus removing any adhered films or dirt which could dampen the flow of water.

Therefore, the present invention refers to an apparatus for controlling the continuous discharge or bleed-off of water of recirculating circuits, pertaining to cooling towers and evaporative condensers, where said type of circuit comprises one water recirculating pump with its inlet connected to a cold water collecting sump or basin which is part of the lower section of a structure which has means for cooling the recirculated water it receives from a series of spray nozzles which are fed by the recirculating pump, where the collecting sump has means to replenish the water level via a float valve and said sump has a piped connected for draining or emptying it and said drain pipe is the recipient of the continuous bleed-off flowing out of an apparatus described as the present invention.

Figure 1D:
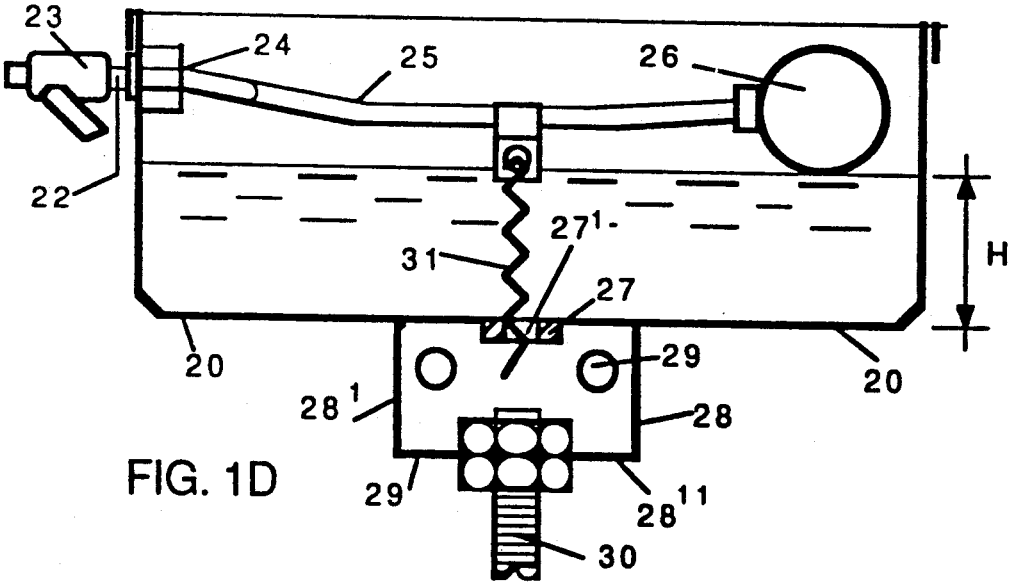
FIG. 1*d* is a schematic sectional view of the apparatus shown in FIG. 1*a*.

With the only purpose of comparing the dimensions of the orifices required in practice, let us assume that the water level "H" in FIG. 1*d*, were 4 inches. On table 3 the diameters are listed for the same BTUH loads used on Table 1 and 2.

TABLE 3

| THERMAL LOAD BTUH | Diameter of the orifices for Bleed-off (inches) | | | | |
|---|---|---|---|---|---|
| | Hardness 50 ppm | Hardness 75 ppm | Hardness 100 ppm | Hardness 125 ppm | Hardness 150 ppm |
| 100,000 | 0.0963 | 0.1312 | 0.1739 | 0.2336 | 0.3475 |
| 250,000 | 0.1523 | 0.2074 | 0.2750 | 0.3694 | 0.5496 |
| 500,000 | 0.2153 | 0.2932 | 0.3888 | 0.5223 | 0.7769 |
| 1,000,000 | 0.3045 | 0.4147 | 0.5499 | 0.7386 | 1.0988 |
| 2,000,000 | 0.4307 | 0.5866 | 0.7778 | 1.0448 | 1.5542 |
| 4,000,000 | 0.6091 | 0.8296 | 1.0999 | 1.4775 | 2.1979 |

Notice that, for example, for 4MM BTUH and 150 ppm this orifice has to be 2.1979" diameter. Compare this with Table 1, where the orifice required is 0.8324". As the cross-sections vary as the square of the diameters, the actual ratio of free areas is:

$(2.1979/08324)^2 = 7$ to 1 (larger)

FIG. 6*a* is similar to FIG. 1*d* except for the configuration of the float arm 25'. According to the present invention, the arm comprises multiple parts: part 25A and part 25B, both parts are independent and are held together by a screw 25C so that the angle or relative position of the part 25B and float ball 26 can be adjusted to attain the desired value of "H". Cleaner filament or twine 31 can be held and secured from either swivel disc 25D or 25E. FIG. 6*b* shows the float ball valve adjusted for a lower level "H".

In instances when the user knows aforehand what flows shall be required during extensive periods, because of different heat loads on the cooling tower, there is another solution which also consists of reducing the water column "H", but in this case, instead of lowering the water level by adjusting the arm of the float valve, the actual orifice is raised, thus reducing the distance between said orifice and the constant water level. FIG. 7 shows a sleeve 50 and two positions of a concentric disc 27, which has an orifice 27', and that can slide up and down inside sleeve 50 to any position along all the height of sleeve 50. A set screw 51 or any other means shall fix the position of disc 27 with its orifice 27'. FIG. 7 depicts a clear difference between heights "H 1"and "H 2". Indicia can be provided in the case of the float arm adjustments or orifice position adjustments which can be correlated to the height of water desired. Thus, the height "H" of water in control container or receptacle 20' (and accordingly, the velocity of discharge $\sqrt{2gh}$) can be set by (1) adjusting arm 25, (2) adjusting the position of orifice 27' relative to the control container, or (3) a combination of (1) and (2).

As noted above, the function of cleaner 31 in FIG. 1*d* is to scrape the circumference of the orifice 27' to attain a cleaning or descaling effect; it was also mentioned that the oscillating movements of twine 31 helped keeping the orifice free of obstructive materials. Practice has taught that depending on the velocity of the water through orifice 27' and the actual diameter of said orifice, the vortex or corioles acceleration, forms a circular ring of water with a hollow core. The Corioles phenomena is noticeable when draining a bath tub or a kitchen sink.

When this phenomena occurs, the linear cleaner 31 may just stay quietly inside the hollow core without efficiently doing its duty.

FIG. 8*a*-8*c* show various solutions which have been successfully tested. The main idea is to attach something protruding at the lower end of cleaner 31; said protrusion must have a size and shape such that the water funneling down the perimeter or circumference of the orifice shall impinge on it. The impinging water will push away the protrusion or surface discontinuity and twine 31 until the water from an opposite position repeats the action and again displaces or agitates the cleaner assembly. In FIG. 8*b* a twister or helix 40D2 is used. FIG. 8*c* linked rings 40D2 are used. Thus, the vertical movements of orifice cleaner member 31 due to the movement of float arm 25 and the lateral swinging (pendulum) and rotary movements of cleaner 31 due to water flow over the protrusion or surface discontinuities serving to effectively maintain the orifice (and its cross-sectional opening or aperture size) clean so that the flow or throughput remains substantially constant for a given height H of water in the control container 20'.

While there has been shown and described a preferred embodiment of the invention, it will be appreciated that various other adaptations and modifications of the invention will be readily apparent to those skilled in the art and it is intended to encompass such obvious modifications and adaptations in the spirit and scope of the claims appended hereto.

What is claimed is:

1. Device for controlling the discharge of water in recirculating circuits of cooling towers and evaporative coolers having a water collection basin having a drain therein, comprising:

a control container, valve means connecting said control container to said recirculating circuit to receive water therefrom and supply same to said control container, means forming an orifice of predetermined size in said control container to permit water to flow from said control container, vertical passage means connecting said orifice with said drain to gravity feed water from said control container to said drain, means for adjusting the height "H" of water in said control container relative to said orifice to adjust the flow rate through said orifice, and means controlling said valve means to maintain the adjusted height "H" of water in said control container substantially constant.

2. The device defined in claim 1 wherein said means for controlling said valve means includes a float, arm means connected to said float and said valve means, said means for adjusting the height "H" of water in said control container includes arm means, said arm means being constituted by first and second members and means for adjusting the angular relationship between said first and second members.

3. The device defined in claim 1 wherein said means for adjusting the height "H" of water in said control container includes means for adjusting the vertical position of said orifice in said control container.

4. The device defined in claim 3 wherein said means for controlling said valve means includes a float on the surface of water in said container and an arm connecting said float with said valve, and means for cleaning said orifice including an elongated cleaning member passing through said orifice and connected to said arm, said elongated cleaning member being moved back and forth in said orifice to remove scale therefrom and maintain the said predetermined size of said orifice, and discontinuity means on said elongated cleaning member for causing said member to swing about in said orifice.

5. A method of maintaining an orifice, through which a quantity of liquid is too flow, clear of scale build-up comprising:

said orifice having an upstream side and downstream side, positioning a cleaning member having discontinuity in said orifice with said discontinuity being at the downstream side of said orifice, whereby gravity flow of liquid through said orifices strikes said discontinuity and oscillates said cleaning member in said aperture in lateral directions to prevent scale and incrustation build-up in said orifice.

6. Device for controlling the discharge of water in water recirculating circuit of cooling towers and evaporative coolers having a water collection basin having a drain therein, comprising:

a control container, valve means connecting said control container to said water recirculating circuit to receive water therefrom and supply water to said control container, an operating arm having a first end connected to said valve means and a second end, a float connected to said second end to engage water whereby the level of water in said control container is maintained substantially constant, at least an orifice in said control container through which said water flows, cleaner means in said orifice, and first means for moving said cleaner means in a vertical direction in said orifice and second means on said cleaner means for causing said cleaner means to oscillate laterally in said orifice and wherein said second means includes a discontinuity on the surface of said cleaner means which is contacted by water flow through said orifice.

7. The invention defined in claim 6 including means for adjusting the height of water n said control container above said orifice.

8. The invention defined in claim 7 wherein said means for varying the position of said orifice includes a sleeve secured to said control container, a disk carrying said orifice and sealingly engaged on the interior of said sleeve and means securing said disk at a predetermined position in said sleeve.

9. The invention defined in claim 7 wherein said means for adjusting includes means for varying the position of said orifice in said control container.

10. The invention defined inn claim 7 wherein said means for adjusting includes said operating arm having at least a first and a second portion between said first and second ends and means for adjusting the angle between said first and second portions.

11. The invention defined in claim 10 wherein said means for adjusting includes means for varying the position of said orifice in said control container.

* * * * *